United States Patent [19]

Habermann et al.

[11] 4,212,725

[45] Jul. 15, 1980

[54] ELECTRODES FOR ELECTROLYSIS PURPOSES

[75] Inventors: Wolfgang Habermann, Mainz; Peter Thoma, Frankenthal; Klaus Wintermantel, Dossenheim, all of Fed. Rep. of Germany

[73] Assignee: BASF Aktiengesellschaft, Fed. Rep. of Germany

[21] Appl. No.: 955,580

[22] Filed: Oct. 30, 1978

[30] Foreign Application Priority Data

Nov. 9, 1977 [DE] Fed. Rep. of Germany ..... 2750029

[51] Int. Cl.[2] ..... C25B 11/08; C25B 11/10; C25B 1/26

[52] U.S. Cl. ..... 204/290 F; 204/290 R

[58] Field of Search ..... 204/290 R, 292, 293, 204/290 F

[56] References Cited

U.S. PATENT DOCUMENTS

| | | | |
|---|---|---|---|
| 3,915,838 | 10/1975 | Lee | 204/290 F |
| 3,977,959 | 8/1976 | Habermann et al. | 204/290 R |

*Primary Examiner*—Howard S. Williams

*Attorney, Agent, or Firm*—Keil & Witherspoon

[57] ABSTRACT

An electrode for electrolysis purposes, which may in particular be used as an anode for the electrolysis of alkali metal chlorides, contains, in addition to an alloy of niobium with a metal of the iron group, tantalum, tantalum carbide or an alloy of tantalum with metals of the iron group, individually or as mixtures. The surface of the electrode is modified with a metal of the platinum group, especially with rhodium.

9 Claims, No Drawings

ELECTRODES FOR ELECTROLYSIS PURPOSES

The present invention relates to an electrode for electrolysis purposes which is in particular employed as an anode in the electrolysis of alkali metal chlorides, especially in amalgam cells.

U.S. Pat. No. 3,977,959 discloses electrodes for electrolysis purposes which contain, in addition to an alloy of tungsten with metals of the iron group, tantalum, tantalum boride, tantalum carbide or an alloy of tantalum with metals of the iron group, individually or as mixtures, and which are surface-modified with a metal of the platinum group, especially with rhodium. When using these anodes in amalgam cells, short-circuits with the amalgam cathode can cause small amounts of tungsten to pass to the cathode, thereby lowering the hydrogen overvoltage.

It is an object of the present invention to provide an electrode which is in particular intended to be used as an anode for the electrolysis of alkali metal chlorides, and which does not exhibit these disadvantages.

We have found that this object is achieved by providing an electrode which contains, in addition to an alloy of niobium with metals of the iron group, tantalum, tantalum boride, tantalum carbide or an alloy of tantalum with metals of the iron group, individually or as mixtures, and which is surface-modified with a metal of the platinum group, especially with rhodium.

The novel electrode has the further advantage over conventional tungsten-containing electrodes that when it is used as an anode in the electrolysis of alkali metal chlorides at a pH of from 2.5 to 4, which is the pH conventionally maintained, up to 50% less chlorate is formed, whilst the oxygen content in the chlorine evolved at the anode is up to 60% lower.

The proportion of tantalum, tantalum boride, tantalum carbide or a tantalum alloy in the electrode should be from at least 10 to about 60 percent by weight, preferably from 30 to 60 percent by weight, in each case calculated as tantalum, in order to give well-adhering, dense corrosion-resistant layers which adequately protect the electrically conductive carrier. It is true that exceptionally stable and resistant anodes are obtained with tantalum contents above 60 percent by weight, but such electrodes exhibit somewhat higher overvoltages, so that as a rule the higher tantalum contents should be avoided.

The metals of the iron group (iron, cobalt and nickel) are particularly advantageous alloying components for use with niobium or tantalum, since these elements give particularly low overvoltages. Iron is preferred; it enables particularly good adhesion to be achieved when the electrode is modified with the platinum metal. The content of metals of the iron group in the niobium alloy and - where relevant - in the tantalum alloy, should in total be less than 10 percent by weight, preferably from 0.5 to 5% by weight. Higher iron contents detract from the corrosion resistance whilst excessively low iron contents fail to ensure adequate adhesion of the platinum metal, and adequate conductivity. Where the electrode contains tantalum in the form of an alloy with metals of the iron group, the ratio of the iron content in the niobium alloy to the content in the tantalum alloy is from 1:0.1 to 1:5.

Platinum metals may be used to modify the electrodes. Rhodium has proved the most advantageous metal, since it is superior to all other platinum metals in respect of adhesion to the electrode surface at high anodic current densities. The content of platinum metal should be less than 1.5 $g/m^2$ of electrode surface, preferably from 0.25 to 0.75 $g/m^2$. The electrodes may be employed as such or applied to an electrically conductive carrier.

Suitable electrically conductive carriers are materials which are substantially resistant to the particular electrolyte used. Preferred carriers are titanium, graphite and especially titanium-tantalum and titanium-niobium alloys, since these alloys are particularly corrosion-resistant. The tantalum or niobium content of the alloys should be at least 10 percent by weight to achieve a substantial improvement compared to unalloyed titanium.

The electrodes can be manufactured by applying a mixture consisting of a fine-particled alloy of niobium with metals of the iron group and fine-particled tantalum, tantalum carbide, tantalum boride or an alloy of tantalum with metals of the iron group to an electrically conductive substrate by means of a plasma torch and then surface-modifying the layer with a platinum metal, especially rhodium. The particle size of the metal powders used should be from 40 to 100 $\mu$m. The powders should be applied under a protective gas atmosphere, preferably argon, to avoid oxidation of the applied layer. The electrodes can, however, also be manufactured by, for example, roller-plating, or electroplating, the electrically conductive substrate with a layer of the above mixtures.

The layers applied to the electrically conductive carrier should, in this process, be more than 0.1 mm thick, and preferably from 0.1 to 0.8 mm thick.

To produce an unsupported electrode, the procedure followed is, for example, to apply a mixture of the fine-particled components, by means of a plasma torch, to a carrier consisting of a base metal, to remove this carrier subsequently, for example by treatment with an acid or alkali, and then to modify the resulting layer with a platinum metal.

The electrodes are modified by impregnating them with a solution containing from 0.1 to 10, especially from 0.5 to 3, percent by weight of an inorganic platinum metal compound and then heating under a protective gas atmosphere at from +600° to +1,200° C., preferably from +800° to +900° C., for from about 1 to 10 seconds. A solution of rhodium(III) chloride in aqueous hydrochloric acid, having a pH of from 0 to 0.5, has proved particularly advantageous as a modifying agent. When using this solution and the iron-containing niobium or tantalum alloys, particularly stable modification and clean electrode surfaces are achieved, since the resulting iron chlorides sublime off immediately during the modification treatment. Furthermore, such electrode surfaces are uncontaminated by oxides and display particularly low overvoltages. The modifying treatment must be carried out under an inert gas atmosphere or in a high vacuum, to avoid oxidation. The preferred protective gas is argon.

When using electrically conductive metallic carriers, the electrodes can also be produced by, for example, first de-greasing the carrier and freeing it from oxides by chemical etching with hydrofluoric acid or oxalic acid or ionic etching with a noble gas under low pressure. Thereafter, the layer of the alloy of niobium with metals of the iron group, if desired simultaneously with tantalum or the tantalum compounds, is then applied to the oxide-free electrically conductive carrier by high vacuum vapor deposition or ion plating. The surface of this layer is then modified with the platinum metals by high vacuum ion plating or implantation.

Finally, an alternative method is to apply the layer of the niobium alloy with metals of the iron group, with tantalum or tantalum compounds, simultaneously with the platinum metal by the vapor deposition, ion plating or plasma process. It has proved advantageous if the content of metals of sub-group VIII in the layer is from about 1/10 to 1/100 of the content at the surface.

EXAMPLE

A titanium sheet of size 30×20×2 mm is corundum-blasted and then coated on one side, to a thickness of about 0.25 mm, with a fine-particled mixture consisting of 50 parts by weight of an alloy composed of 95 percent by weight of niobium and 5 percent by weight of iron and 50 parts by weight of tantalum, coating being carried out with the aid of a plasma torch. The coated side is then impregnated with a 1.5 percent strength by weight solution of rhodium(III)chloride (calculated as $RhCl_3$), of pH 0.2. After drying, the layer is heated for about 2 seconds to about +900° C. by means of an argonnitrogen plasma, and is cooled to room temperature with argon.

The finished anode is particularly suitable for the electrolysis of spent dye liquors, alkali metal chloride solutions and sulfuric acid. The overvoltage in an aqueous alkali metal chloride solution is about 30 mV under a load of 2.3 $kA/m^2$ of anode surface.

We claim:

1. An electrode for electrolysis purposes, which contains, in addition to an alloy of niobium with a metal of the iron group, tantalum, tantalum boride, tantalum carbide or an alloy of tantalum with metals of the iron group, individually or as mixtures, and is surface-modified with a metal of the platinum group.

2. An electrode as claimed in claim 1, wherein the content of metals of the iron group in the electrode is not greater than 10% by weight.

3. An electrode as claimed in claim 1, wherein the content of tantalum, tantalum boride, tantalum carbide or tantalum alloy is from 10 to 60% by weight, in each case calculated as tantalum.

4. An electrode as claimed in claim 1, wherein the metal of the platinum group is rhodium.

5. An anode for the electrolysis of alkali metal chlorides which comprises:

(a) an alloy of niobium and a metal of the iron group, said iron group metal being present in the alloy in the amount of from 0.5 to 10% by weight;

(b) tantalum, tantalum boride, tantalum carbide or an alloy of tantalum and a metal of the iron group, said alloy containing from 0.5 to 10% by weight of the metal of the iron group; and (c) a metal of the platinum group applied to the surface of the anode, the content of the platinum metal being from 0.25 to 1.5 $g/m^2$ of anode surface.

6. The anode of claim 5, wherein the content of metals of the iron group in the electrode is not greater than 10% by weight.

7. The anode of claim 5, wherein the content of tantalum, tantalum boride, tantalum carbide or tantalum alloy is from 10 to 60% by weight, in each case calculated as tantalum.

8. The anode of claim 5, wherein the metal of the platinum group is rhodium.

9. The anode of claim 5, wherein both niobium and tantalum are present as alloys of iron and wherein the ratio of the iron content in the niobium alloy to the iron content in the tantalum alloy is from 1:0.1 to 1:5.

* * * * *